US005618210A

United States Patent [19]

Grant

[11] Patent Number: 5,618,210

[45] Date of Patent: Apr. 8, 1997

[54] HANGLESS JUMPER CABLE HANDLES

[76] Inventor: George E. Grant, 11739 NE. 128th Ave., Okeechobee, Fla. 34972

[21] Appl. No.: 490,458

[22] Filed: Jun. 14, 1995

[51] Int. Cl.[6] ..... H01R 4/48

[52] U.S. Cl. ..... 439/822; 439/506; 24/505; 24/506

[58] Field of Search ..... 439/502, 504, 439/506, 729, 759, 822, 828, 829, 834, 835, 836; 24/505, 506, 517

[56] References Cited

U.S. PATENT DOCUMENTS

| | | | |
|---|---|---|---|
| 4,072,388 | 2/1978 | Dunn | 439/829 |
| 5,021,008 | 6/1991 | Scherer | 439/504 |
| 5,166,478 | 11/1992 | Sprouse | 439/504 |

*Primary Examiner*—Neil Abrams
*Assistant Examiner*—Brian J. Biggi

[57] ABSTRACT

Jumper cables (30), (54) and (62) with handles (10), (32) and (56) that do not become entangled when the cables (30), (54) and (62) are being moved to or from their stored positions. The new handles (10), (32) and (56) contain the normally open handle leg ends (17) and (19), (34) and (36), (70) and (72) in a closed position, thereby avoiding any entanglements. Embodiments of the new handles (10), (32) and (56) include: 1. a handle (10) in which normally open ends (17) and (19), (FIG. 1A) are contained in a closed position (FIG. 1C) by means of a notch (20), a latch (22), and a latch hook (21); 2. a handle (32) in which normally open ends (34) and (36), (FIG. 2A) are contained in a closed position (FIG. 2B) by means of semi-circular ring (38); and 3. a handle (56) in which normally open ends (70) and (72), (FIG. 3A) are contained in a closed position (FIG. 3B) by means of a cuff (64).

3 Claims, 2 Drawing Sheets

HANGLESS JUMPER CABLE HANDLES

BACKGROUND

Field of Invention

This invention relates to electrical jumper cables, specifically to jumper cable handles having means for rendering the handles hangless.

Description of Prior Art

Jumper cable handles, also known as jumper cable clamps, have been in use for many years. They are primarily used with cables connecting a "live" battery to a "dead" battery; and for using the electrical potential of the "live" battery to start the motor of the vehicle whose battery is considered to be "dead". Jumper cable handles are fabricated in several designs, shapes, colors, sizes and lengths to make them attractive to potential buyers. Jumper cables and handles are mostly kept in storage and are used only when needed on rare occasions. Each time they are needed, they are taken from storage, used, and put back into storage. In their normal state, the open handles tend to become hooks for entangling all objects in their path when the jumper cables to which they are attached are being moved from or into storage. The entanglement of the open handles with other objects usually comes at a time when the user of the cables is low on patience, his wrath is inflamed and he may become a danger to society. Users of jumper cables are preoccupied with the task of getting their motors started, and the cables are used so seldom that little time is given for designing hangless jumper cable handles. The hangless jumper cable handle is a new, useful and unobvious invention. This application is complementary to Applicant's earlier application for "Covered Automotive Jumper Cables", U.S. Pat. No. 5,573,426 filed 1995 Mar. 28.

OBJECTS AND ADVANTAGES

Accordingly, several objects and advantages of Applicant's invention are:

(a) to render jumper cable handles hangless;

(b) to provide jumper cable handles that will be safe to use, that will not ensnare objects that create dangerous situations such as overturning containers of gas or other hazardous elements;

(c) to provide jumper cable handles that when used will not arouse the wrath of the user by becoming entangled with other objects;

(d) to provide jumper cables with hangless handles that may be moved from storage, used and restored more efficiently and in a timely manner that will save the user much valuable time;

(e) to provide jumper cables with hangless handles that may be neatly stored in out-of-the-way places to eliminate unsightly scenes and prevent possible tripping accidents;

(f) to streamline the handle to keep it from hanging on objects when removing the jumper cable to which it is attached from a stored location or when dragging the handles through grass while pulling the cable, as is often done in common practice;

Further objects and advantages of this invention will become apparent from a consideration of the drawings and ensuing descriptions.

DRAWING FIGURES

The drawings show various embodiments of the means for rendering the handles hangless.

REFERENCE NUMERALS IN DRAWINGS

Figure 1B:
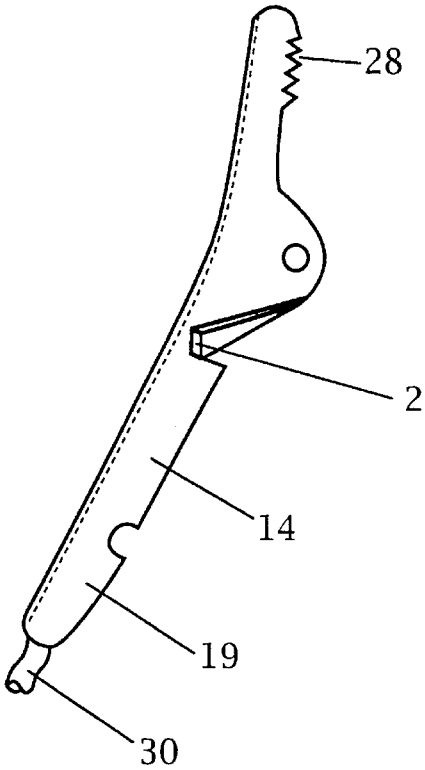
FIGS. 1A, 1B and 1C are plan views illustrating a notch and latch design for rendering the handles hangless.

10 cable handle
12 handle leg
13 leg end
14 handle leg
15 leg end
16 pivot pin
17 leg end
18 spring
19 leg end
20 formed notch
21 latch hook
22 rotatable latch
24 rivet
26 serrated surface
28 serrated surface
30 electric jumper cable
32 handle
34 handle leg
36 handle leg
38 semi-circle ring
40 holes for ring
42 serrated surface
44 serrated surface
46 leg end
48 leg end
50 spring
52 pivot pin
54 electric cable
56 handle
58 handle leg
60 handle leg
62 electric cable
64 cuff
65 cuff opening
66 pivot pin
68 spring
70 leg end
72 leg end
74 leg end with serrated surface
76 leg end with serrated surface

DESCRIPTION - FIGS. 1, 2 & 3

Figure 1A:
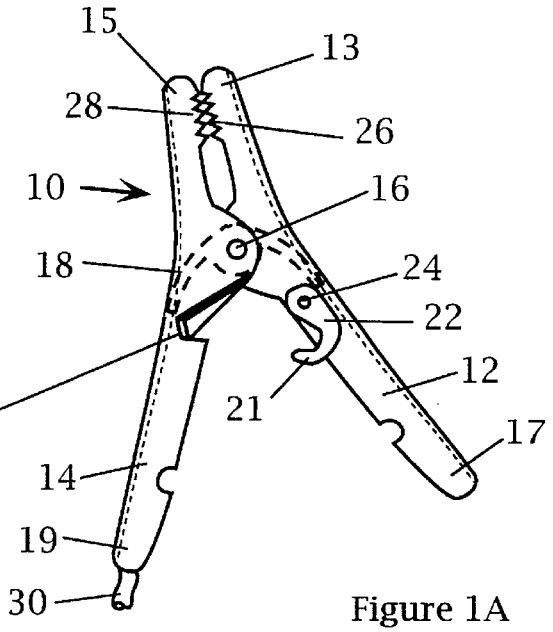
Figure 1C:
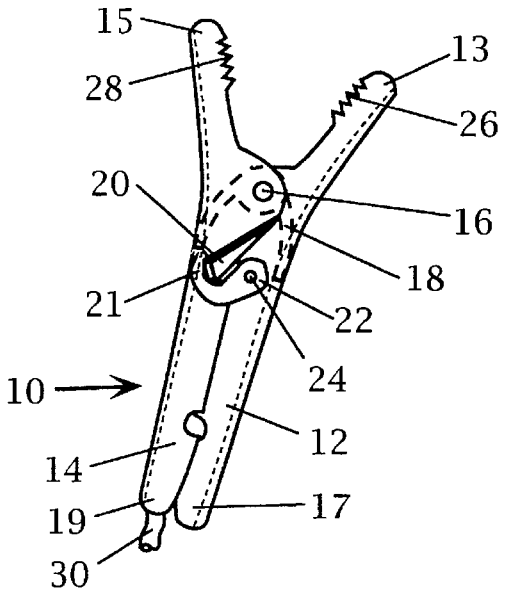

An embodiment of this invention of hangless jumper cable handles is illustrated in FIGS. 1A, 1B and 1C. A typical cable handle 10 is shown consisting of a leg 12 and a leg 14 joined together by a pivot pin 16. A spring 18 (shown in phantom) is coiled around pin 16. Leg 14 contains a formed notch 20. Leg 12 has a latch 22 held in place by a rivet 24. Latch 22 contains a hook 21 and is rotatable around rivet 24. Shown in the closed position in FIG. 1A are ends 13 and 15 of legs 12 and 14 respectively. Ends 13 and 15 each contain a surface of serrations 26 and 28 respectively. Spring 18 forces ends 13 and 15 into the closed position and simultaneously forces ends 17 and 19 into the open position. A manual force of a predetermined amount is necessary to force ends 17 and 19 into the closed position (see FIG. 1C) and simultaneously forces ends 13 and 15 into the open position. Alternately, when ends 17 and 19 are in the open position (see FIG. 1A), ends 13 and 15 are in the closed position. Leg 14 is electrically connected to an electric cable 30 by means not shown. FIG. 1B is an enlarged view of leg 14, showing notch 20. FIG. 1C shows handle 10 with serrated surfaces 26 and 28 in the open position, and ends 17 and 19 of legs 12 and 14 respectively in the closed position. Latch 22 is shown in FIG. 1C with hook 21 engaged onto notch 20.

Figure 2B:
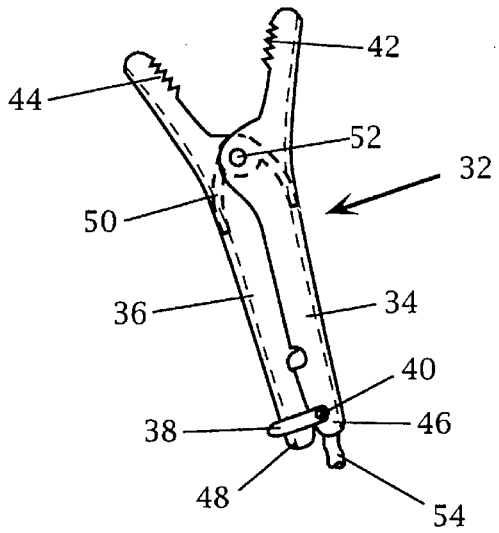
FIGS. 2A and 2B are plan views of a handle having a ring capable of rendering the handles hangless.
Figure 2A:
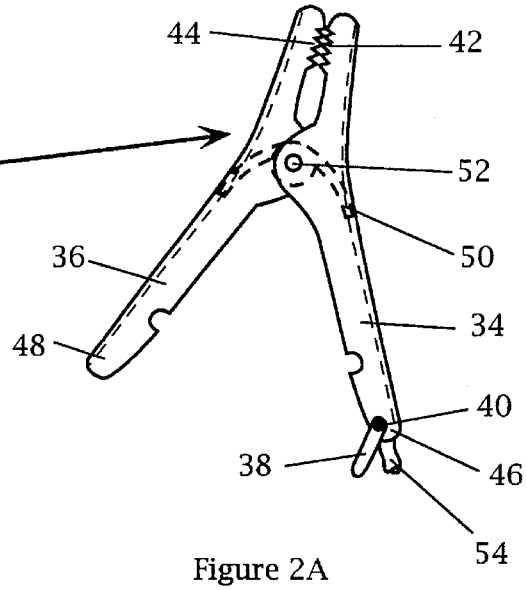

Another embodiment of this invention is shown in FIGS. 2A and 2B. A handle 32 is similar to handle 10 in FIGS. 1A and 1C, but has no notch and no latch. Handle 32 is shown consisting of a leg 34 and a leg 36, joined together by a pivot pin 52 and activated by a spring 50, coiled around pin 52. Leg 34 has a semi-circle ring 38, with ends bent a predetermined amount for insertion into holes 40 on each side of leg 34. FIG. 2B shows a serrated end 42 and a serrated end 44 of legs 34 and 36 respectively in the open position. Opposite ends 46 and 48 of legs 34 and 36 respectively are shown in the closed position with ring 38 rotated clockwise a predetermined amount to secure ends 46 and 48 in the closed position.

Figure 3B:
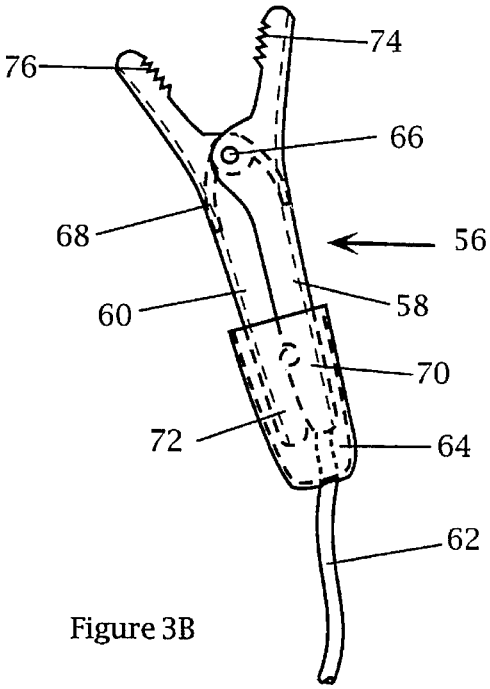
FIGS. 3A and 3B are plan views of a handle having a slidable cuff capable of rendering the handles hangless.
Figure 3A:
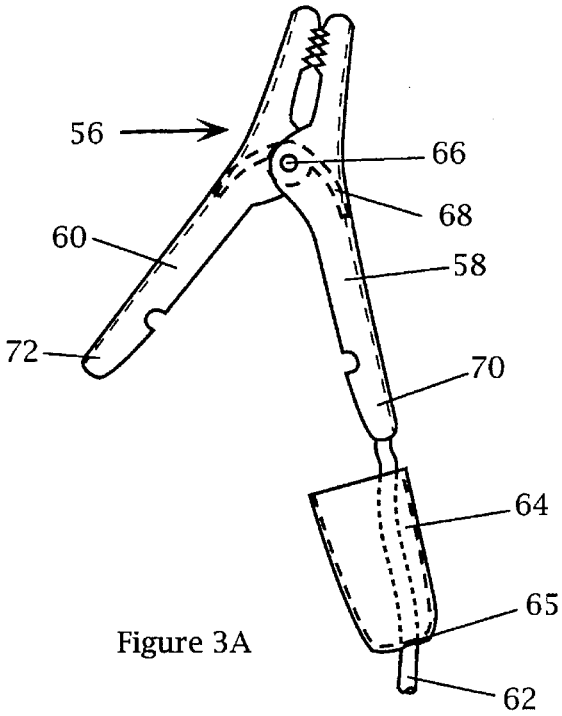

Another embodiment of this invention is shown in FIGS. 3A and 3B. A handle 56 is similar to handles 10 and 32. Handle 56 is shown consisting of a leg 58 and a leg 60 joined together by a pivot pin 66 and activated by a spring 68 coiled around pin 66. Leg 58 is electrically connected by means not shown to an electric cable 62. An open cuff 64 is slideably connected to and surrounds cable 62 by use of the small opening 65 in the bottom of the cuff. FIG. 3B shows a serrated end 74 and a serrated end 76 in the open position. An end 70 and an end 72 are shown in the closed position. Cuff 64 is shown securing ends 70 and 72 in the closed position. Cuff 64 may be made of plastic, rubber, fabric or other suitable material.

OPERATION - FIGS. 1A, 1B, 1C; 2A, 2B; 3A & 3B

Prior to this invention, handles 10, 32 and 56, when not in use, assumed the positions shown in FIGS. 1A, 2A and 3A respectively. The serrated ends 13 and 15; 42 and 44; and 74 and 76 are in the closed position, while the opposite ends are in the open position. Springs 18, 50 and 68 force legs 12 and 14, 34 and 36, and 58 and 60 respectively to rotate a predetermined amount around pivot pins 16, 52 and 66 respectively to maintain the open positions of leg ends 17 and 19, 46 and 48, and 70 and 72 respectively. FIG. 1C illustrates that handle 10 has been closed by manually compressing leg ends 17 and 19 together. While manually held in this position, latch 24 is rotated clockwise a predetermined amount for hook 21 to engage notch 20. When the manual compression of leg ends 17 and 19 is relented, spring 18 forces hook 21 to maintain its engagement with notch 20, as shown in FIG. 1C. When in storage, handle 10 will be in the position as shown in FIG. 1C. When jumper cable 30 is removed from storage, the closed position of ends 17 and 19 will permit the easy movement of handle 10 around whatever obstacles may be in its path.

Similarly, FIG. 2B illustrates handle ends 46 and 48 in the closed position and semi-circle ring 38 has been manually rotated clockwise around hole 40, over leg end 48. The tension of spring 50 causes ring 38 to remain engaged on leg end 48. The position of legs 34 and 36 as shown in FIG. 2B is the position for storing handle 32. When cable 54 is being moved to or from storage, the closed position of leg ends 46 and 48 will permit the easy movement of handle 32 around all obstacles in its path.

FIG. 3B illustrates that handle ends 70 and 72 have been manually forced together, cuff 64 has been manually forced to slide along cable 62 to secure leg ends 70 and 72 in the closed position. When the manual force holding leg ends 70 and 72 is removed, tension spring 68 forces leg ends 70 and 72 to engage the inside surface of cuff 64 and to remain in the closed position. When cable 62 is removed from storage or is being moved to storage, the closed position of leg ends 70 and 72 will permit the easy movement of handle 56 around all obstacles in its path.

SUMMARY, RAMIFICATIONS AND SCOPE

Accordingly, the reader will see that the jumper cable handles of this invention can be moved from storage, over vine-covered terrain or other areas without becoming entangled with any obstacles. Furthermore, the hangless jumper cable handle has the additional advantages in that (a) it permits the production of handles in a variety of embodiments to please the discriminating buyer;

(b) it permits the use and storage of jumper cables in a safe and efficient manner;

(c) it permits the use of jumper cables in a pleasant manner and prevents mental anguish from entangled handles.

Thus the scope of the invention should be determined by the appended claims and their legal equivalents, rather than by the examples given.

I claim:

1. A jumper cable handle comprising (a) a first leg, having an end with a serrated surface and an opposite end having an unserrated surface;

(b) a second leg having an end with a serrated surface and an opposite end having an unserrated surface;

(c) a pivot pin; said first leg pivotally attached to said second leg by said pivot pin;

(d) mechanical means for rotating the legs on the pin, forcing the serrated ends into a closed position and simultaneously forcing the opposite ends into an open position, wherein the mechanical means comprises a spring coiled around the pivot pin having opposite ends of a predetermined length forced against an inside surface of each of the unserrated ends of the legs;

(e) manual means for counteracting the mechanical means of part (d) and reversing the rotation of the legs on the pin, and (f) restraining means for maintaining the serrated ends in an open position while simultaneously containing the opposite ends in a closed position, wherein the restraining means comprises: a latch rotatably attached to the first leg by a rivet; and a notch formed on the second leg whereby the latch is securely attached to the second leg.

2. The jumper cable handle of claim 1 wherein the restraining means comprises: a semicircular ring rotateably attached to the unserrated end of the first leg, means to rotate the ring and to enclose and secure the unserrated end of the second leg.

3. The jumper cable handle of claim 1 wherein the restraining means comprises: a cuff slideably attached to a jumper cable, and means for enclosing the unserrated leg ends in the cuff.

* * * * *